US006503425B1

(12) United States Patent
Thorbjörnsson et al.

(10) Patent No.: US 6,503,425 B1
(45) Date of Patent: Jan. 7, 2003

(54) METHOD FOR FORMING OF A FIBER MAT

(75) Inventors: Sven-Ingvar Thorbjörnsson, Karlstad (SE); Mikael Mathiasson, Alnö (SE)

(73) Assignee: Valmet Fibertech AB (SE)

( * ) Notice: Subject to any disclaimer, the term of this patent is extended or adjusted under 35 U.S.C. 154(b) by 0 days.

(21) Appl. No.: 09/720,060

(22) PCT Filed: Jun. 3, 1999

(86) PCT No.: PCT/SE99/00956

§ 371 (c)(1),
(2), (4) Date: Dec. 20, 2000

(87) PCT Pub. No.: WO00/00332

PCT Pub. Date: Jan. 6, 2000

(30) Foreign Application Priority Data

Jun. 26, 1998 (SE) ..... 9802306
Oct. 22, 1998 (SE) ..... 9803650

(51) Int. Cl.[7] ..... B27N 3/00
(52) U.S. Cl. ..... 264/40.1
(58) Field of Search ..... 264/40.1; 425/140

(56) References Cited

U.S. PATENT DOCUMENTS 5,496,570 A 3/1996 Mauss et al. ..... 425/83.1

FOREIGN PATENT DOCUMENTS

WO 96/16776 6/1996

*Primary Examiner*—Mary Lynn Theisen
(74) *Attorney, Agent, or Firm*—Lerner, David, Littenberg, Krumholz & Mentlik, LLP

(57) ABSTRACT

A method for continuously forming a fiber mat for use in manufacturing fiberboard is disclosed including metering fibrous material, depositing the fibrous material onto a moving surface, forming a fiber mat from the fibrous material by applying adjustable rotary rolls to the surface of the fiber mat with the rolls being disposed along a predetermined direction and including a final adjustable rotary roll, in which a bulb of the fibrous material is formed prior to the final adjustable rotary roll which, in turn, defines the upper surface of the fiber mat, detecting the size of the bulb of fibrous material, and controlling the vertical position of the final adjustable rotary roll based on the size of the bulb of fibrous material.

8 Claims, 2 Drawing Sheets

METHOD FOR FORMING OF A FIBER MAT

BACKGROUND OF THE INVENTION

The present invention relates to a method for continuously forming a fiber mat for manufacturing fiberboard according to the dry method.

When producing fiberboard according to the dry method (MDF, HDF, LDF, etc.) a fiber mat is formed on a moving transport means and subsequently pressed in a hot pressing operation. The mat can be formed as a single, homogenous, layer or in multiple layers, with different characteristics for fiber, resin, moisture, etc., and such a fiber mat can also be formed on top of other types of mats, such as OSB, wafer board, particle board, etc., to create a smooth surface layer.

Forming of the mat is usually performed in a passive way, i.e. by merely spreading the fibers onto a moving belt or wire and then adjusting the thickness of the mat by removing fibers from the upper surface of the mat. For instance, the forming can be performed by carrying the fibers in an airstream from a fiber bin and depositing them onto a wire screen while sucking the air through the mat and screen, or by purely mechanical deposition of the fibers, after being metered from a dosing bin, onto a number of spreader rolls, which spread the fibers down onto a forming belt, forming a mat on the belt. There are also systems available which include combinations of pneumatic and mechanical systems.

The mat so formed is in each of these cases adjusted by means of a scalper roll system to obtain an even upper surface and more important a correct mat weight. This scalper operation results in a certain amount of the fibers already formed being pneumatically transported back to the fiber bin. The amount of fibers so recirculated amounts to about 20 to 40% of the final fiber mat for a pneumatic system, and 5 to 15% for a mechanical one. This operation thus increases the load onto the former itself, requires a pneumatic system and electric energy for the transport and will finally degrade the fibers, due to mechanical treatment when passing the transport fan, aging of the resin due to the longer dwell time until hot pressing and uncontrolled change of the moisture content of the material when recirculated.

The distribution of fibers crosswise when using the pneumatic type of former is carried out by means of a mechanical nozzle or impulse air pushing the falling fibers to one side or the other. This method is very sensitive to changes in the pneumatic balances, and requires frequent observation and adjustment.

When using the mechanical type of former, most of the crosswise distribution is determined by the spreading of fibers into the dosing bin, and little can be done when the mat is formed.

A conventional mechanical former is disclosed in U.S. Pat. No. 5,496,570. This patent shows a bed of forming rolls working above the mat for spreading the fibers. This patent also shows a typical scalper roll used for adjusting the mat surface.

International Application No. WO 96/16776 shows a device for levelling a particulate material web or mat. This device consists of elliptical disks which are used to even out the upper surface of a formed mat with the aim of diminishing the scalping.

Co-pending Swedish Patent Application No. 9800209-0 discloses a method and an apparatus for improving the forming operation and eliminating the scalping off operation by means of a set of rotating forming rolls with forming blades working in the deposited material. It has been found to be essential to control the position of the last forming roll as described in this co-pending application.

It is an object of the present invention to provide a method for controlling the last roll in the set of rolls as described in the above mentioned Swedish patent application.

SUMMARY OF THE INVENTION

In accordance with the present invention, this and other objects have now been realized by the invention of a method for continuously forming a fiber mat having an upper surface comprising metering fibrous material, depositing the metered fibrous material onto a moving surface, the moving surface moving in a predetermined direction, forming the fiber mat from the fibrous material by applying a plurality of adjustable rotary rolls to the surface of the fiber mat, the plurality of adjustable rotary rolls being disposed along the predetermined direction and including a final adjustable rotary roll in the predetermined direction, whereby a bulb of the fibrous material is formed prior to the final adjustable rotary roll in the predetermined direction and the final adjustable rotary roll defines the upper surface of the fiber mat, detecting the size of the bulb of the fibrous material, and controlling the vertical position of the final adjustable rotary roll based on the size of the bulb of the fibrous material. In a preferred embodiment, the detecting of the size of the bulb of the fibrous material comprises measuring the size of the bulb by mechanically contacting the surface of the bulb.

In accordance with one embodiment of the method of the present invention, detecting of the size of the bulb of the fibrous material comprises measuring the size of the bulb without contacting the surface of the bulb.

In accordance with another embodiment of the method of the present invention, the method includes rotating the final adjustable rotary roll by means of a motor, and wherein detecting of the size of the bulb of the fibrous material comprises using a signal from the motor. Preferably, the signal from the motor comprises the motor current, and the method includes treating the motor current in a load transmitter.

In accordance with another embodiment of the method of the present invention, detecting of the size of the bulb of the fibrous material comprises detecting the difference in height between the height of the final adjustable rotary roll and the height of the surface of the fiber mat formed thereby. In a preferred embodiment, detecting of the difference in height between the height of the final adjustable rotary roll and the height of the surface of the fiber mat comprises measuring the height of the surface of the fiber mat by mechanically contacting the surface of the fiber mat.

In accordance with another embodiment of the method of the present invention, detecting of the difference in the height of the final adjustable rotary roll and the height of the surface of the fiber mat comprises measuring the height of the surface of the fiber mat without contacting the surface of the fiber mat.

The objects of the present invention are carried out by means of a bulb of material which is formed in front of the last roll. Control of the vertical position of the last roll can be obtained by controlling the size of the bulb, directly by indicating the height or volume of the bulb of fiber material or, alternatively, indirectly by indicating the difference in height between the last roll and the mat after the last roll. The indication in the form of a signal can be used for closed loop control of the vertical movement of the last roll.

Thus, it has been found that the volume of the fiber bulb in front of the last roll represents a buffer volume of fiber material. If fiber material is lacking in the incoming mat to the last roll, i.e. if there is a "hole" or indentation in the mat, then this buffer can be used to fill this "hole", as long as the buffer volume is sufficient. In addition, the fact that the roll is throwing material in both directions will help to supply material to sections of the mat with a lack of material.

If a section of the mat with too high a local mat thickness approaches the last roll, this excessive material is absorbed by the bulb, and is also thrown sideways so that it is spread over the width of the mat. This is valid until the bulb reaches a height such that excessive fibers are thrown over the roll on top of the outgoing mat.

Thus, it has shown to be essential for good forming according to the present invention to maintain good control of the height of this fiber bulb. Too low a bulb height, i.e. too high a roll setting, will result in "holes" in the formed mat, while too high a bulb height, i.e. too low a roll setting, will result in fibers being thrown over the last roll, thereby creating an uneven mat.

Furthermore, it is also critical to adjust the position of the last roll continuously in relation to the mat density. This can also automatically be achieved by control of the bulb.

The alternative way of controlling the level of the last forming roll is to use the difference in height between the last roll and the mat height after the last roll. This difference is also related to the size of the bulb before the last roll. If the last roll is set too high, then the difference is large and, at the same time, the fibers pass under the last roll without a bulb being created. If the last roll is set too low, then the difference is small or even negative and a large bulb is created, resulting in fibers being thrown over the last roll, thereby adding to the mat height. Thus, also by means of this indirect indication of the size of the bulb, it is possible to maintain a suitable bulb size in order to control the vertical position of the last forming roll, and thereby obtain the equalizing effect on the mat forming as described above.

BRIEF DESCRIPTION OF THE DRAWINGS

The present invention is further described and explained in the following detailed description, which refers to the Figures, which show some embodiments of the present invention.

DETAILED DESCRIPTION

Figure 1:
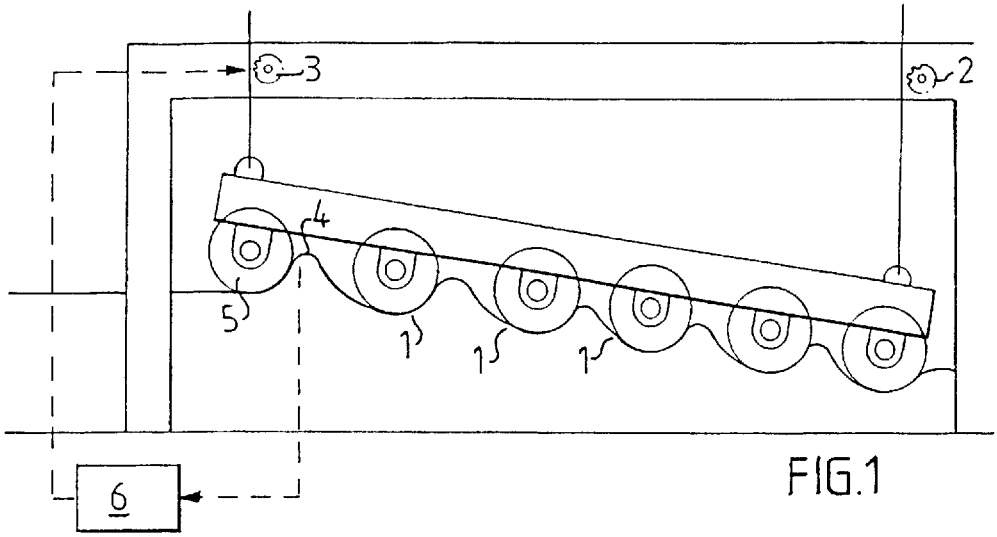
FIG. 1 is side, elevational, partially schematic view of a set of vertically adjustable forming rolls according to the present invention.
Figure 2A:
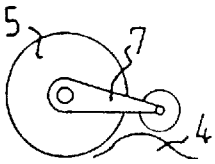
FIG. 2*a* is a partial side, elevational view of an indicating device based on contact indication for use in accordance with the present invention.
Figure 2B:
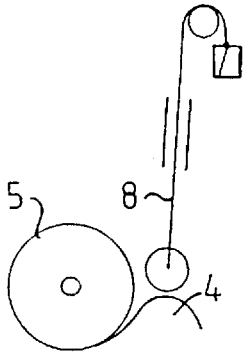
FIG. 2*b* is a partial side, elevational view of another indicating device based on contact in accordance with the present invention.
Figure 2C:
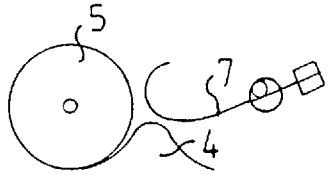
FIG. 2*c* is a partial side, elevational view of another indicating device based on contact in accordance with the present invention.
Figure 2D:
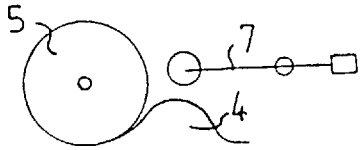
FIG. 2*d* is a partial side, elevational view of another indicating device based on contact in accordance with the present invention.
Figure 2E:
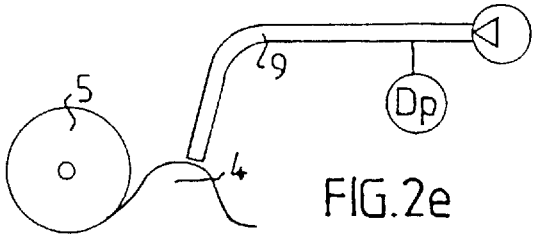
FIG. 2*e* is a partial side, elevational view of another indicating device based on contact in accordance with the present invention.

Referring to the Figures, in which like reference numerals refer to like elements thereof, FIG. 1 shows a general view of the forming head area, where fibers are metered down from a dosing bin onto forming rolls 1 in the right portion of the figure, and the formed mat is transported to the left in the figure. The rolls 1 as shown in Swedish Patent Application No. 9800209-0 are movable vertically as required, by means of jacks, 2 and 3, to obtain the best forming, and the height of the last roll 5 is set so that an even mat is produced. Other alternatives of the forming head shown in FIG. 1 can be learned from the above mentioned Swedish patent application.

The height or volume of the fiber bulb 4 before the last roll 5 is measured, and the signal is used for closed loop control 6 of the lifting device, for example, a jack 3. If the jack is not centrally located above the roll, an algorithm for this deviation must be introduced into the closed loop.

Figure 3A:
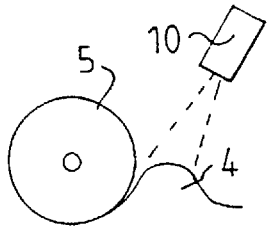
FIG. 3*a* is a partial side, elevational view of an indicating device not based on contact for use in accordance with the present invention.
Figure 3B:
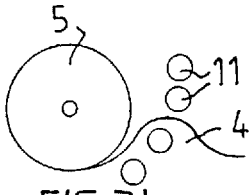
FIG. 3*b* is a partial side, elevational view of an indicating device not based on contact for use in accordance with the present invention.
Figure 4:
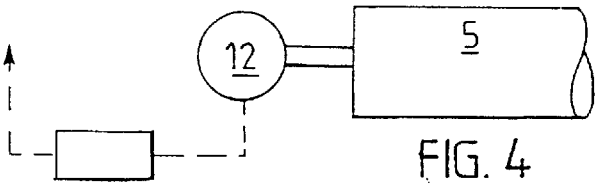
FIG. 4 is a partial side, elevational view of yet another indicating device for use in accordance with the present invention.

The signal from the bulb measuring device may be obtained in different ways, and FIGS. 2–4 show some solutions.

In FIG. 2 some mechanical devices for contact measuring of the top of the bulb are shown. A swinging arm 7 or movable line 8 can have a potentiometer, a pulse encoder or the like for measuring the position of the arm or line. As is shown in FIG. 2*e* a fluidistor 9 can be used for the measuring. The signal from this measuring to be used for the closed loop 6.

FIGS. 3*a* and *b* show some solutions where contact-free measuring is utilized. In FIG. 3*a* an analog signal from a device 10 is used to measure from above, and in FIG. 3*b* a number of on/off photocells 11 or the like are used, reading from outside a glass sidewall.

FIG. 4 shows the principle where a motor 12 is used for rotating the last roll 5. A suitable signal from the motor 12 (such as rpm, motor power, motor current, motor torque, cos $\phi$, etc.) is used for determining the bulb height. A preferred solution is to use the signal for the motor current, which is treated in a load transmitter. In such a transmitter, both the active and reactive current are measured. When working from an idling situation when the reactive current is rather large, to a situation when some load is applied to the motor from the fiber bulb, and when the reactive current diminishes, i.e. the motor efficiency increases (cos $\phi$ increases), this actually used span in motor current can be used, and the outfeed signal can then be set to from about 4 to 20 mA for this span. Thus reliable control of the roll height can be achieved without external measuring devices.

Figure 5A:
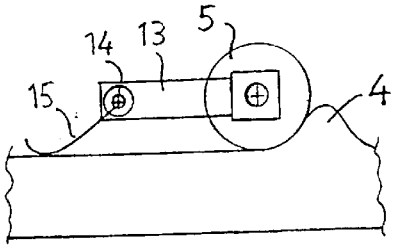
FIG. 5*a* is a partial side, elevational view of another indicating device based on contact for use in connection with the present invention.

FIGS. 5*a* and *b* and 6*a* and *b* show some embodiments which can be used if the difference between the height of the last forming roll 5 and the mat height after this last roll is used for control.

Figure 5B:
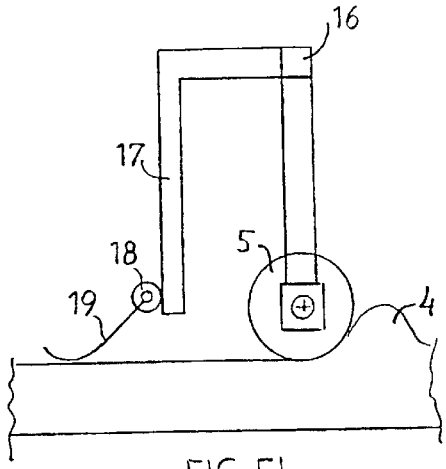
FIG. 5*b* is a partial side, elevational view of another indicating device based on contact for use in connection with the present invention.

FIGS. 5*a* and *b* show contact indication principles. FIG. 5*a* shows a structure 13 located on the inside of the forming wall. A measuring sensor 14, such as an angular sensor, is attached to this structure. The sensor 14 has some sort of sliding or rolling member 15 in contact with the mat. FIG. 5*b* shows a similar structure 16 located on the outside of the former area with a vertical member 17 arranged at a suitable position along the width of the mat where a measuring sensor 18 with a sliding member 19 is attached.

Figure 6A:
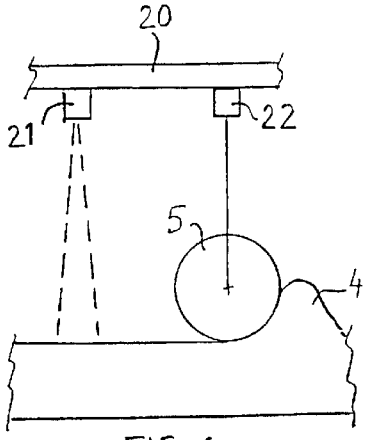
FIG. 6*a* is a partial side, elevational view of another indicating device not based upon contact for use in accordance with the present invention.
Figure 6B:
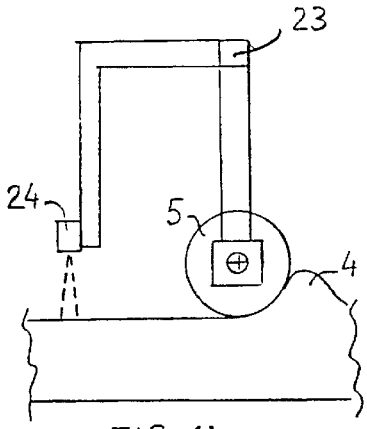
FIG. 6*b* is a partial side, elevational view of another indicating device not based upon contact for use in accordance with the present invention.

FIGS. 6*a* and *b* show contact-free indication principles. FIG. 6*a* shows a fixed structural beam 20 on top, where measuring sensors, 21 and 22, for the vertical position of the last roll 5 and the mat height, respectively, are attached. The difference between the values in the form of signals from these two sensors, 21 and 22, is used for control. FIG. 6*b* shows a structure 23 which is movable vertically with the last roll 5. In this manner, only one measuring sensor 24 is required.

Surprisingly, it has been found that the bulb 4 can be maintained at a certain size if the difference as described above is kept at a constant measure within the range of from about −15 to +25 mm, and in most cases within the range of from about −5 to +15 mm. The setpoint is slightly influenced by the thickness of the mat, the level of the first roll (the first jack 2), fiber characteristics and fiber moisture. However, these conditions can be compensated for by adding recipes for the difference in the main control system.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A method for continuously forming a fiber mat having an upper surface comprising metering fibrous material, depositing said metered fibrous material onto a moving surface, said moving surface moving in a predetermined direction, forming said fiber mat from said fibrous material by applying a plurality of adjustable rotary rolls to the surface of said fiber mat, said plurality of adjustable rotary rolls being disposed along said predetermined direction and including a final adjustable rotary roll in said predetermined direction, whereby a bulb of said fibrous material is formed prior to said final adjustable rotary roll in said predetermined direction and said final adjustable rotary roll defines said upper surface of said fiber mat, detecting the size of said bulb of said fibrous material, and controlling the vertical position of said final adjustable rotary roll based on said size of said bulb of said fibrous material.

2. The method of claim 1 wherein said detecting of said size of said bulb of said fibrous material comprises measuring said size of said bulb by mechanically contacting the surface of said bulb.

3. The method of claim 1 wherein said detecting of said size of said bulb of said fibrous material comprises measuring said size of said bulb without contacting the surface of said bulb.

4. The method of claim 1 including rotating said final adjustable rotary roll by means of a motor, and wherein said detecting of said size of said bulb of said fibrous material comprises using a signal from said motor.

5. The method of claim 4 wherein said signal from said motor comprises said motor current, and including treating said motor current in a load transmitter.

6. The method of claim 1 wherein said detecting of said size of said bulb of said fibrous material comprises detecting the difference in height between the height of said final adjustable rotary roll and the height of the surface of said fiber mat formed thereby.

7. The method of claim 6 wherein said detecting of said difference in height between the height of said final adjustable rotary roll and the height of said surface of said fiber mat comprises measuring said height of said surface of said fiber mat by mechanically contacting said surface of said fiber mat.

8. The method of claim 6 wherein said detecting of said difference in said height of said final adjustable rotary roll and said height of said surface of said fiber mat comprises measuring said height of said surface of said fiber mat without contacting said surface of said fiber mat.

* * * * *